US005669944A

United States Patent [19]

Cerutti et al.

[11] Patent Number: 5,669,944

[45] Date of Patent: Sep. 23, 1997

[54] METHOD FOR PRODUCING UNIFORMLY HIGH QUALITY ABRASIVE COMPACTS

[75] Inventors: David B. Cerutti, Worthington; James A. Adkins, Columbus, both of Ohio

[73] Assignee: General Electric Company, Pittsfield, Mass.

[21] Appl. No.: 555,672

[22] Filed: Nov. 13, 1995

[51] Int. Cl.[6] ..... B24D 3/00

[52] U.S. Cl. ..... 51/309; 51/293; 51/307

[58] Field of Search ..... 51/293, 307, 309

[56] References Cited

U.S. PATENT DOCUMENTS

| | | | |
|---|---|---|---|
| Re. 32,380 | 3/1987 | Wentorf, Jr. et al. | 407/119 |
| 4,403,015 | 9/1983 | Nakai et al. | 428/565 |
| 4,411,672 | 10/1983 | Ishizuka | 51/309 |
| 4,766,040 | 8/1988 | Hillert et al. | 428/552 |
| 5,009,673 | 4/1991 | Cho | 51/293 |
| 5,022,894 | 6/1991 | Vegarali et al. | 51/293 |
| 5,176,720 | 1/1993 | Martell et al. | 51/293 |
| 5,248,317 | 9/1993 | Tank et al. | 51/293 |
| 5,351,772 | 10/1994 | Smith | 51/293 |

*Primary Examiner*—Deborah Jones

[57] ABSTRACT

The formation of uniformly high quality abrasive compacts, especially cubic boron nitride compacts, is achieved by employing a substrate material (comprising a carbide such as tungsten carbide and a ferrous metal such as cobalt) having a titanium content of not greater than 100 ppm as shown by analysis. Preferably, the maximum tantalum content is also not greater than 100 ppm.

11 Claims, No Drawings

METHOD FOR PRODUCING UNIFORMLY HIGH QUALITY ABRASIVE COMPACTS

BACKGROUND OF THE INVENTION

This invention relates to the production of abrasive compacts, and more particularly to the production of high quality compacts having excellent adhesion between abrasive particles.

The use of abrasive compacts as forming and working tools or raw material therefore is well known. Abrasive materials therein include diamond and cubic boron nitride ("CBN"), sometimes collectively designated "abrasive" hereinafter. Particularly useful are compacts of synthetic diamond produced under high pressure, high temperature (hereinafter "HPHT") conditions.

In the production of such compacts, a substrate material comprising a carbide support and a catalyst/solvent material for the abrasive is typically employed. A typical substrate material is predominantly metal carbide, especially tungsten carbide, combined with a ferrous metal such as iron, cobalt or nickel which serves as a catalyst/solvent material in the case of diamond compacts. For cubic boron nitride compacts, catalyst/solvent materials include aluminum and its compounds and alloys.

The substrate and catalyst/solvent material is combined with abrasive particles, the latter being present in major proportion, and the combination is subjected to HPHT conditions. The combination of ferrous metal and catalyst/solvent (identical in the case of diamond) sweeps through the abrasive particles causing them to sinter and bond together, resulting in the formation of a compact having the desired cutting and/or working properties.

A disadvantage encountered in commercial practice of this method of compact production, especially with CBN as the abrasive, is variability in the quality of the compacts obtained. High quality compacts have a securely bonded abrasive layer on the front side. In many poor quality compacts, the abrasive is inadequately bonded an/or cracked, with the result that the compact must be rejected since it will not survive extended usage. Compact quality may be extremely erratic, with the formation of many of excellent quality followed by just as many, or sometimes more, of poor quality rendering them unusable.

Various sources of substrate material have been utilized in compact production. The prior art, as exemplified by U.S. Pat. Nos. 5,009,673, 5,022,894 and Re 32,380, discloses that the substrate material may compose tungsten carbide, titanium carbide, tantalum carbide, molybdenum carbide or a mixture thereof. Although tungsten carbide is disclosed as generally being preferred, no operative distinction between these metals is made. Accordingly, commercially practiced compact fabrication procedures do not distinguish between substrate materials on the basis of the presence of absence of metals other than tungsten.

SUMMARY OF THE INVENTION

The present invention is based on the discovery that, contrary to the aforementioned prior art, the presence of certain non-tungsten metals in the substrate material has a serious effect on the quality of the compact produced, particularly when the abrasive is CBN. In particular, the presence of titanium in proportions above 100 ppm cannot be tolerated since higher levels will cause the aforementioned problems necessitating compact rejection. It also appears that the presence of more than threshold levels of tantalum is detrimental.

Accordingly, the invention is a method for producing an abrasive compact which comprises:

analyzing for titanium a substrate material comprising a carbide support material and a ferrous metal, and rejecting any of said substrate material having a titanium content greater than 100 ppm;

subjecting a combination of said substrate material, a catalyst/solvent material and abrasive particles comprising diamond or cubic boron nitride to high pressure, high temperature conditions effective to sweep said ferrous metal through said abrasive particles and bond and sinter any diamond present.

DETAILED DESCRIPTION; PREFERRED EMBODIMENTS

As previously mentioned, the method of this invention is of particular significance in the production of CBN compacts. It may also be employed, however, for diamond compact fabrication.

The substrate materials employed in the method of the invention comprise, as previously stated, a carbide support and a ferrous metal. Typical ferrous metals, which serve as catalyst/solvent materials for formation of diamond compacts, are iron, cobalt and nickel, with cobalt generally being preferred. The highly preferred carbide support material is tungsten carbide. In general, the carbide support material is present in major amount, typically at least 80% by weight, with the balance being ferrous metal.

In the fabrication of diamond compacts, the ferrous metal also serves as a catalyst/solvent. With CBN, however, aluminum, its compounds such as aluminum nitride, and aluminum alloys of such metals as cobalt, nickel and manganese are typically employed.

The essential feature of the invention is the titanium content of the substrate material, which should in no event be greater than 100 ppm. Therefore, an essential feature of the invention is the analysis of the substrate material for titanium, followed by the rejection of any material having a titanium content greater than 100 ppm. Preferably, any material having a tantalum content greater than 100 ppm is also rejected. Analysis for titanium and tantalum may be performed by conventional means by either the compact manufacturer or the raw material supplier.

The reason for the adverse effect of titanium is not known with certainty. It is believed, however, that the titanium may react with the nitrogen in the CBN to form titanium nitride, which forms a layer between the substrate and the CBN and inhibits sweep of the ferrous metal, causing a decrease in bonding between the CBN particles.

Following analysis of the substrate material and rejection of any unsuitable samples thereof, conventional compact-forming operations are performed. These may include, for example, placing layers of substrate material, catalyst/solvent and CBN particles in a suitable container, typically a cylindrical sleeve of a shield metal such as zirconium, titanium, tantalum, tungsten or molybdenum. It should be noted that the employment of titanium or tantalum for this purpose according to the invention is not foreclosed, since the container contacts the compact-forming constituents only on the outside surface and is not blended with said material during the HPHT operations.

In general, the thickness ratio of substrate to abrasive table in the finished compact is in the range of about 1–6:1. In the abrasive table, the proportion of abrasive is at least about 70% and preferably at least about 90% by volume.

Catalyst/solvent may be present in the abrasive table in amounts typically on the order of 4–10%.

The combination of substrate and abrasive material is subjected to HPHT conditions in the diamond stable pressure-temperature region, typically a pressure in the range of 40–50 kbar at a temperature in the range of 1000°–1300° C., for a period of time sufficient to bond and sinter the grains of abrasive material. Times of 3–120 minutes are typical. During this step, the ferrous metal sweeps through (i.e., infiltrates) the abrasive particles and serves as a bonding aid. Upon cessation of the HPHT conditions, cooling and removal of the container, a compact of uniformly high quality is obtained.

The invention is illustrated by a series of conventional CBN compact-forming runs employing tungsten carbide, cobalt and aluminum nitride. Various tungsten carbide-cobalt blends were employed, having titanium contents from 3 to 3900 ppm. Samples having titanium contents of 3, 4.7 and 5.3 ppm produced uniformly high quality compacts. Samples having titanium contents from 1900 to 3900 ppm produced compacts characterized by cracked diamond surfaces.

What is claimed is:

1. A method for producing an abrasive compact which comprises:

(1) forming a substrate material comprising a carbide support material and a binder metal wherein said substrate material has a titanium content no greater than 100 ppm; and (2) subjecting a combination of said substrate material, a catalyst/solvent material and abrasive particles to high pressure, high temperature conditions effective to sweep said catalyst/solvent material through said abrasive particles to bond and sinter said abrasive particles.

2. A method according to claim 1 wherein the abrasive particles are diamond.

3. A method according to claim 1 wherein the abrasive particles are synthetic diamond.

4. A method according to claim 1 wherein the abrasive particles are cubic boron nitride and the catalyst/solvent material is aluminum or an alloy or compound thereof.

5. A method according to claim 4 wherein the support material is tungsten carbide.

6. A method according to claim 4 wherein the ferrous metal is iron, cobalt or nickel.

7. A method according to claim 4 wherein said binder metal is cobalt.

8. A method according to claim 4 wherein the catalyst/solvent material is aluminum.

9. A method according to claim 4 wherein the catalyst/solvent material is a nickel-aluminum alloy.

10. A method according to claim 4 wherein the catalyst/solvent material is aluminum nitride.

11. A method according to claim 1 where the substrate material has a tantalum content no greater than 100 ppm.

* * * * *